US008006804B2

(12) United States Patent
Coleman et al.

(10) Patent No.: US 8,006,804 B2
(45) Date of Patent: Aug. 30, 2011

(54) SYSTEM AND METHOD FOR IMPROVING THE SATISFACTION OF CUSTOMERS OF A HIGH-VOLUME RESTAURANT

(75) Inventors: Anthony M. Coleman, Groveland, MA (US); Marianne Graziadei, Little Falls, NY (US)

(73) Assignee: Pumpernickel Associates, LLC, Richmond Heights, MO (US)

( * ) Notice: Subject to any disclaimer, the term of this patent is extended or adjusted under 35 U.S.C. 154(b) by 802 days.

(21) Appl. No.: 11/222,580

(22) Filed: Sep. 9, 2005

(65) Prior Publication Data

US 2006/0004634 A1 Jan. 5, 2006

Related U.S. Application Data

(63) Continuation of application No. 10/642,075, filed on Aug. 15, 2003.

(51) Int. Cl.
*E04H 3/04* (2006.01)

(52) U.S. Cl. ..... 186/38

(58) Field of Classification Search ..... 186/38, 186/52, 33; 705/1, 15; 99/484; 426/665
See application file for complete search history.

(56) References Cited

U.S. PATENT DOCUMENTS

| | | | | | |
|---|---|---|---|---|---|
| 3,957,326 | A | * | 5/1976 | Molitor | 312/236 |
| 4,154,027 | A | | 5/1979 | Searcy | |
| 4,245,720 | A | * | 1/1981 | Neill, Jr. | 186/38 |
| 4,388,689 | A | | 6/1983 | Hayman et al. | |
| 4,415,065 | A | | 11/1983 | Sandstedt | |
| 4,530,067 | A | | 7/1985 | Dorr | |
| 4,569,421 | A | | 2/1986 | Sandstedt | |
| 4,588,047 | A | * | 5/1986 | de Reynal de Saint Michel | 186/38 |
| 4,971,377 | A | * | 11/1990 | Aquilante | 296/22 |
| 5,128,862 | A | | 7/1992 | Mueller | |
| 5,193,648 | A | * | 3/1993 | Yuter | 186/38 |
| 5,235,509 | A | | 8/1993 | Mueller et al. | |
| 5,285,604 | A | * | 2/1994 | Carlin | 52/79.1 |
| 5,573,082 | A | * | 11/1996 | Conlan et al. | 186/44 |
| 5,829,176 | A | | 11/1998 | Gruneisen, III | |
| 5,944,143 | A | * | 8/1999 | Papas et al. | 186/44 |
| 6,415,555 | B1 | | 7/2002 | Montague | |
| 6,561,317 | B1 | | 5/2003 | Dudley | |
| 2003/0046166 | A1 | | 3/2003 | Liebman | |
| 2005/0273343 | A1 | | 12/2005 | Coleman et al. | |

OTHER PUBLICATIONS

Jonathan Jameson, "Not by Bread Alone", Brandweek; Oct. 20, 2003; 44, 38; ABI/INFORM Global.
Anne Christensen, "Panera deliciously fills the need for bakery in north springs", The Gazette, Colorado Springs; Sep. 20, 2002, p. GO.29.
MontanaMills.com, Feb. 2003.
Jim Price; "Bakers Dozens", Milwaukee Journal Sentinel; Milwaukee, Wis; Dec. 2, 2001, p. 1.N.
Barbara J. Kelly; "Panera Bread brings European bakery concepts to Pearl Street"; Boulder county Business report; Boulder; Feb. 23, 2001; vol. 20, Iss. 5; p. A3.
Galleyline.com; Oct. 10, 2003.
Welcome to Montana Mills; www.montanamills.com.
Visit Your Local Village Bakery; www.montanamills.com.

* cited by examiner

*Primary Examiner* — Mark Beauchaine
(74) *Attorney, Agent, or Firm* — Fish & Richardson P.C.

(57) ABSTRACT

A bakery-cafe is arranged and operated in a manner that efficiently moves a customer within the bakery-cafe to, for example, improve customer satisfaction by minimizing customer wait times.

8 Claims, 2 Drawing Sheets

SYSTEM AND METHOD FOR IMPROVING THE SATISFACTION OF CUSTOMERS OF A HIGH-VOLUME RESTAURANT

RELATED APPLICATION DATA

This application is a continuation of and claims benefit to U.S. application Ser. No. 10/642,075 which application is incorporated herein by reference in its entirety.

FIELD OF INVENTION

This invention generally relates to systems and methods for improving customer satisfaction and, more particularly, to a system and method for improving the satisfaction of a customer of a bakery-cafe.

BACKGROUND

Customer satisfaction is an important goal. In this regard, it is appreciated that a satisfied customer is likely to be a repeat customer and that repeat customers are profitable as a reliable source of regular business. In addition, it is understood that a satisfied customer is a useful marketing tool since satisfied customers consistently recommend an establishment to their friends, family, and coworkers. For these reasons, among others, there is a strong desire to improve customer satisfaction and customer loyalty.

For the purpose of maximizing customer satisfaction by reducing the perceived wait time in a restaurant having a relatively high volume of customers, different items of a food order are often made by food preparers at various work stations. For example, as described in U.S. Pat. No. 4,388,689, one individual may have the responsibility of preparing salads while a second individual has the responsibility of preparing cooked entrees. In order to maximize the efficiency of food preparation, each food preparer should be working on the same order at a particular point in time so that the order is quickly completed.

While such systems are intended to reduce the amount of customer wait time, the results have been less than desirable. Specifically, the benefits associated with preparing food in a more timely manner are virtually nullified by current inefficiencies associated with moving the customer within known bakery-cafes. Accordingly, a need remains for an improved system and method for arranging and operating a bakery-cafe that will function to improve overall customer satisfaction.

SUMMARY OF THE INVENTION

The following describes a bakery-cafe which is arranged and operated in a manner that efficiently moves a customer within the bakery-cafe to, for example, improve customer satisfaction by minimizing customer wait times. An appreciation of this and other objects, advantages, features, properties and relationships of the system and method will be obtained from the following detailed description and accompanying drawings which set forth illustrative embodiments that are indicative of the various ways in which the disclosed principles may be employed.

BRIEF DESCRIPTION OF THE DRAWINGS

For a better understanding of the disclosed system and method reference may be had to preferred embodiments shown in the following drawings in which.

DETAILED DESCRIPTION

With reference to the figures, the following discloses a system and method for improving the satisfaction of a customer of a bakery-cafe. More specifically, the disclosed system and method is intended to improve customer satisfaction by, among other things, reducing the amount of customer wait time. In addition, the disclosed system and method is intended to improve customer satisfaction by providing a more enjoyable, overall experience during the time the customer is within the bakery-cafe. While the system and method is described in the context of a bakery-cafe, it is to be understood that this description is not intended to be limiting. Rather, those of ordinary skill in the art will readily appreciate how to apply the various improvements described hereinafter to other types of retail endeavors.

Figure 1:
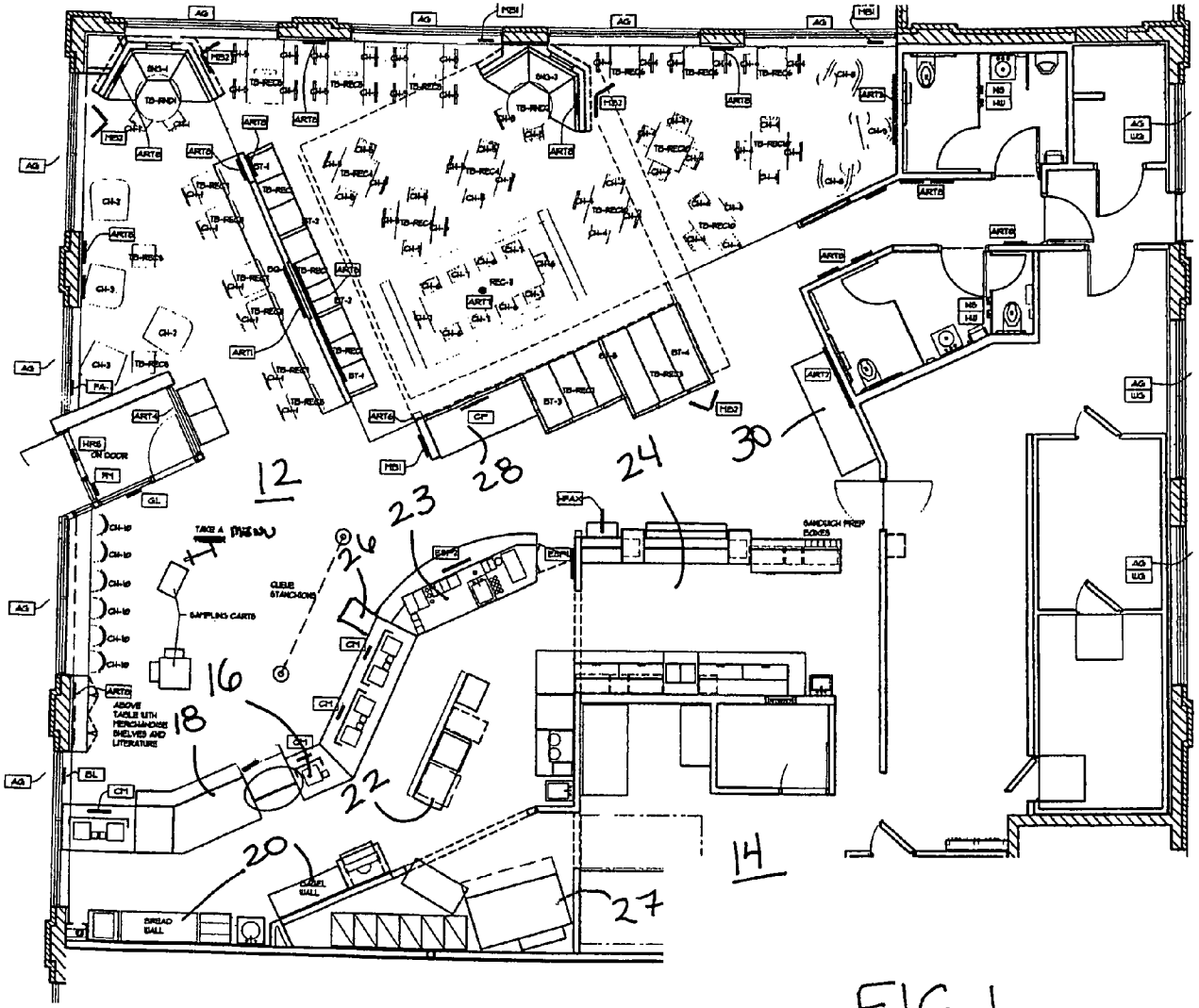
FIG. 1 illustrates a floor plan or an exemplary bakery-cafe having a layout conducive to improving customer satisfaction.

More specifically, the disclosed bakery-cafe is particularly arranged and operated for the purpose of efficiently moving a customer within the bakery-cafe to, for example, minimize customer wait times. To this end, FIG. 1 illustrates the floor plan layout of an exemplary bakery-cafe the operation of which will be described in greater detail hereinafter. Generally, the bakery-cafe illustrated in FIG. 1 includes a general customer area 12 having varied seating, e.g., booths and chairs with tables, and a food preparation and food staging area 14. As will be appreciated, the general customer area 12 is the area in which the customer is free to move. Meanwhile, the food preparation and food staging area 14 is intended to be accessed only by the employees of the bakery-cafe. Accordingly, various of the stations that are to be described hereinafter will also serve the function of separating the general customer area 12 from the food preparation and food staging area 14.

Within the food preparation and food staging area 14, the illustrated bakery-cafe may include one or more order entry stations 16. The order entry stations 16 are desired to be positioned adjacent to a display case 18 in which is displayable pre-prepared food items such as baked goods of a relatively fragile nature (e.g., cakes, brownies, croissants, danish, specialty pastries, etc.) and one or more wire shelves/baskets 20 in which pre-prepared food items such as baked goods of a relatively more sturdy nature (e.g., breads, bagels, etc.) are displayable. The wire shelves/baskets 20 are further preferably positioned along a wall (i.e., a "bread and/or bagel wall") that is located in an area generally behind the display case 18 so as to be out of reach of customers. Food product displayed within the display case 18 and in the shelves/baskets of the bread/bagel wall 20 may be labeled for easy identification by the customer. For reasons that will become apparent, it may also be preferred that the order entry stations 16, the display case 18, and the bread/bagel wall 20 be positioned in an area that is in the general vicinity of an entrance to the bakery-cafe and that the food products within the display case 18 and the wire shelves/baskets 20 (which are readily viewable to a customer entering the bakery-cafe) be quickly accessible to an employee operating in the vicinity of an order entry station 16.

Further positioned within the food preparation and food staging area 14 of the exemplary bakery-cafe illustrated in FIG. 1 is a pre-prepared food bulk storage station, i.e., a "bulk-bagel station 22," a beverage preparation station 23, and a food product preparation station 24 (for example, a staging area of food products utilized to prepare salad, sandwich, and/or soup for delivery to a customer). The bulk-bagel station 22 is preferably located adjacent to one or more ovens 27 used to prepare bagels/bread for sale and/or for use in connection with the preparation of sandwich/soup products. The bulk-bagel station 22 need not be in a location that is readily viewable by a customer. Rather, for reasons that will be described hereinafter, the bulk-bagel station 22 is particularly provided to be accessed by an employee of the bakery-cafe, to fill bulk orders for pre-prepared food products, to restock the wire shelves/baskets 20 holding pre-prepared food products, etc.

Meanwhile, the beverage preparation station 23 is illustrated as being located intermediate the bulk bagel station 22 and the food product preparation station 24. The beverage preparation station 23 is preferably provided for the purpose of fulfilling orders for specialty beverages, e.g., espresso, cappuccino, latte, tea, blended ice coffee, and/or those drinks that generally require the mixing of ingredients. While the preparation of the specialty drinks takes place in the beverage preparation station 23 of the food preparation and food staging area 14, the beverage preparation station 23 is preferably provided with a counter or the like whereby prepared beverage products may be delivered to the customer within the general customer area 12. Drinks that do not need to be especially prepared, such as fountain drinks and/or coffee, may be made accessible to the customer within the general customer area 12. In this regard, bottled drinks may also be made accessible to a customer within the general customer area 12 or may be stored in the food preparation area 12 and delivered to customer. Thus, by way of example, the general customer area 12 may be provided with a cooler 26 for keeping customer-accessible bottled drinks, a coffee filling area 28 for keeping customer-accessible coffee dispensers, and/or a customer-accessible soft drink fountain area 30. In the illustrated bakery-cafe, the coffee filing area 28 is positioned in the vicinity of the beverage preparations station 23 (to allow easy refilling of the coffee dispensers with coffee brewed in the beverage preparation station 23) and a fountain drink filing area 30 is positioned in the vicinity of the food product preparation station 24. In the case where bottled drinks are made customer accessible, the bakery-cafe may include a cooler that is positioned adjacent to the order entry stations 16.

The food product preparation station 24 is illustrated as being located at an end of the food preparation and food staging area 14 that is opposite the order entry stations 16. As noted, the food product preparation station 24 is preferably provided for the purpose of fulfilling orders for salads, sandwiches, and/or soups. For facilitating the delivery of take-out orders to customer, the food product preparation station 24 may also be provided with a counter or the like whereby prepared food products may be delivered to the customer within the general customer area 12. To minimize the time needed to prepare salads, sandwiches, and/or soup (i.e., for serving in a bread bowl or the like), the food product preparation station 24 is further preferably positioned in the vicinity of storage areas (such as walk in refrigerators and freezers) and food pre-preparation stations (such as sinks, chopping and cutting areas, microwave ovens, toasters, etc.). In this manner, the amount of distance and, therefore, time required to stage food products for quickly preparing food product orders may be minimized.

For facilitating an increase in customer throughput for the purpose of generally reducing customer queue times, the order entry stations 16 are preferably provided with one or more point-of-sale cash registers that are linked to one or more order printers and/or order screens that are located in the vicinity of the work stations. In a conventional manner, a customer will verbally convey their order to a cashier manning an order entry station 16 and the cashier will, in turn, be responsible for entering the order into the combined cash register/order input system. The cash register/order input system will then calculate the total price and deliver (all or part of) the order to the order printer/order screen of an appropriate work station (22, 23, and/or 24) within the bakery-cafe for fulfillment of the order, if necessary. In the event an order has been routed to a work station (22, 23, and/or 24), the customer may also be directed to the appropriate work stations so as to queue the customer for relevant order pick-up.

To link order/customer pairs at the various work stations (22, 23, and/or 24), a reference indicia, such as a number, may be assigned to each order. This indicia may be printed on a receipt or the like that is provided to the customer (or the customer may be verbally informed as to their assigned indicia). In this same manner, the indicia is also preferably provided to an operator of a work station (22, 23, and/or 24), for example by being printed on an order request or by being viewable on an order screen, so as to allow the operator to match food product that is to be prepared at the work station to the correct customer. It is to be appreciated that the indicia may be automatically assigned by the cash register/order input system (typically as a number assigned in a numerically increasing order) or may be manually entered into the system. In this regard, the indicia may be manually assigned when, for example, the customer is provided with a placard or the like having a pre-printed indicia which will serve as a means for identifying a customer to a waiter which is designated to bring prepared food product to a customer sitting with the general customer area 12.

Figure 2:
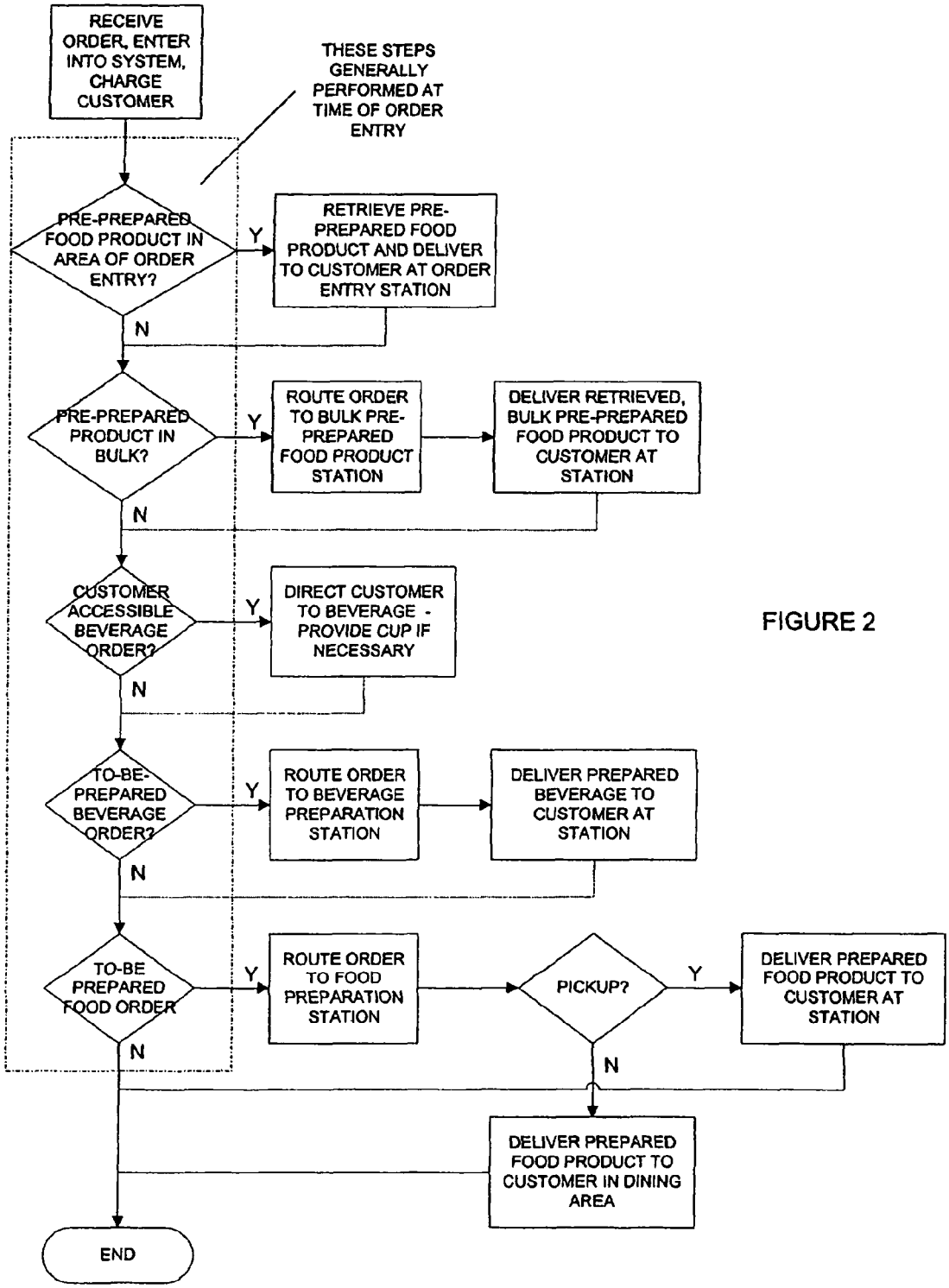
FIG. 2 illustrates a flow chart diagram of an exemplary method for providing food product to customers in the exemplary bakery-cafe illustrated in FIG. 1.

More specifically, when a customer provides an order to an operator of an order entry station 16, the operator will enter the order into the cash register/order input system and charge the customer the appropriate amount, as illustrated in FIG. 2. In the event that the order includes an order for pre-prepared food products that are within the display case 18 and/or wire shelves/baskets 20, an order filler, i.e., a "backer," or the operator of the order entry station 16 may fulfill the order by retrieving the ordered food product from the display case 18 and/or wire shelves/baskets 20 which, as previously noted, are conveniently located in close proximity to the order entry stations 16. This order fulfillment may then be presented to the customer while the customer is at the order entry station 16. In this manner, it will be apparent that the location of pre-prepared food products in the vicinity of the order entry station 16 will function to minimize queue times by minimizing food product retrieval times, especially during the morning rush hour when the demand for pre-prepared food products is likely to be at its highest. It will also be apparent that the location of the pre-prepared food products in an area that is readily viewable by customers in the vicinity of the entrance of the bakery-cafe will also function to minimize customer ordering time (and hence customer wait time) as customers will have an opportunity to quickly discern which food products are available for ordering upon entrance to the bakery-cafe.

In the event that the order includes an order for pre-prepared food product in a bulk quantity (e.g., a dozen or more), the order is preferably routed to the bulk order fulfillment station 22 where an operator of the bulk order fulfillment station 22 will be responsible for filling the order. At this time, the customer will also be directed to move toward the bulk order fulfillment station 22 so as to be in a position to receive the fulfilled order. In this manner, the current customer is efficiently removed from the ordering queue to thereby allow the next customer to place their order. Similarly, the operator of the bulk order fulfillment station 22 will be able to quickly fill the order, having bulk quantities of the pre-prepared food product readily available, to further reduce the wait time of the customer.

In the event that the order includes an order for pre-prepared beverage product (e.g., coffee, fountain drink, or bottled beverages), the customer is directed to retrieve the ordered beverage at the appropriate beverage storage location (e.g., cooler 26, coffee filing area 28, and/or soft-drink fountain area 30). As noted previously, bottled beverages may alternatively be retrieved by a backer or order entry operator and provided to the customer at the order entry station 16. If required, the customer may be provided with the appropriate cup prior to leaving the order entry station 16. Again, it will be appreciated that allowing the customer to access pre-prepared beverage products will eliminate any wait time associated with an order entry operator retrieving the product for the customer. Furthermore, once the customer is directed to the pre-prepared beverage product, the current customer is efficiently removed from the ordering queue to thereby allow the next customer to place their order.

In the event that the order includes an order for beverage product that requires preparation by an employee of the bakery-cafe, the order is preferably routed to the beverage product fulfillment station 23 where an operator of the beverage product fulfillment station 23 will be responsible for filling the order. At this time, the customer will also be directed to move toward the beverage product order fulfillment station 23 so as to be in a position to receive the fulfilled order. As before, this method of routing the order and the customer serves to efficiently remove the current customer from the ordering queue to thereby allow the next customer to place their order.

In the event that the order includes an order for food product that requires preparation, the order is preferably routed to the food preparation station 24 where an operator of the food preparation station 24 will be responsible for filling the order. If the order is specified as a pick-up order, the customer will also be directed to move toward the food preparation station 24 so as to be in a position to receive the fulfilled order. If the order is specified as a dine-in order, the customer may be provided with a placard having an indicia by which the customer is identifiable in the customer area 12 for delivery of the prepared food product. Once again, it will be understood that this method of routing customers and food orders functions to efficiently remove the current customer from the ordering queue to thereby allow the next customer to place their order. Similarly, since the operator of the food preparation station 24 will have food product staged for food product preparation, the operator of the food preparation station will also be able to quickly fill the order to further reduce the wait time of the customer.

From the foregoing, it is also to be understood that the arrangement of the various stations of the illustrated, exemplary bakery cafe also functions to move the customer from a first side of the bakery cafe, i.e., the area of the order entry stations 16, towards an opposite side of the bakery cafe in an efficient manner to minimize customer wait times/travel distances. In this regard, the bulk order fulfillment station 22 is conveniently located in a position prior to the beverage preparation station since bulk orders for pre-prepared food products are likely to be fulfilled quicker than orders for to-be-prepared beverage products. Similarly, the beverage preparation station 23 is conveniently located in a position prior to the food preparation station 24 since it is likely that the to-be-prepared beverage orders will be fulfilled prior to the fulfillment of the to-be-prepared food order. It will also be appreciated that the illustrated arrangement of the stations may also alleviate customer congestion at the various stations.

As a further means for enhancing the appearance of the bakery-cafe, it is preferred that no menus be posted on the walls behind the order entry stations. Rather, it may be desired to position a menu pickup station at a location that is prior to entry into order entry station queue(s). A customer may then take a menu from the menu pickup station and view the menu while moving through the order entry queue. The providing of menus to customers in this manner may be especially desirable to customers with poor eye sight as they are allowed to examine a menu that they would not otherwise be able to clearly see if it were posted on a wall behind the order entry stations 16.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalents thereof.

What is claimed is:

1. A bakery-cafe arranged to enhance customer satisfaction by reducing customer wait time, said bakery-cafe comprising:

a general customer area having varied seating;

an elongated food preparation and staging area extending along a substantial length of the bakery-cafe in front of one or more backwalls of the bakery-cafe;

a display case containing pre-prepared baked food items positioned between the general customer area and the food preparation and staging area, with the pre-prepared baked food items visible to the general customer area;

a plurality of baskets positioned within the food preparation and staging area on one or more of the back walls of the bakery-cafe and containing baked bread goods prepared on-premise, with the baked bread goods visible to the general customer area;

a plurality of stations arranged sequentially for moving customers during food and beverage ordering and delivery from one or more order stations at a first side of the bakery-cafe towards an opposite side of the bakery-cafe in an efficient manner, said plurality of stations comprising:

the one or more order entry stations positioned at a first side of the bakery cafe between the general customer area and the food preparation and staging area and in the vicinity of a first end of the food preparation and staging area, in the vicinity of the display case and generally in front of the plurality of baskets, and arranged to position an operator of the order entry station within the food preparation and staging area;

a bulk order fulfillment station positioned within the food preparation and staging area and intermediate the one or more ordering stations and a beverage product fulfillment station;

the beverage product fulfillment station positioned between the general customer area and the food preparation and staging area, and intermediate the bulk order fulfillment station and a food preparation station, and comprising a beverage preparation station within the food preparation and staging area;

a beverage self fulfillment station positioned within the general customer area;

the food preparation station comprising a food preparation counter positioned within the food preparation and staging area, at an end of the food preparation and staging area opposite from the one or more order entry stations at the first side of the bakery cafe;

a prepared food pick-up and delivery station positioned between the general customer area and the food preparation and staging area and in the vicinity of the food preparation station; and an oven positioned within the food preparation and staging area in the vicinity of the baskets for on-premise preparation of the baked bread goods, the oven being visible to the general customer area.

2. The bakery-cafe as recited in claim 1, comprising a communication system linking personnel operating the food preparation counter with the order entry station.

3. The bakery-cafe as recited in claim 2, wherein the communication system comprises a display visible to the personnel operating the food preparation counter which displays certain orders received via the order entry station.

4. The bakery-cafe as recited in 1 wherein the bulk order fulfillment station is positioned in the vicinity of the oven.

5. The bakery-cafe as recited in 1 wherein the food preparation station is positioned in the vicinity of one or more food storage areas.

6. The bakery-cafe as recited in 1 wherein the beverage self fulfillment station accessible from the general customer area comprises one or more locations selected from among: a soft drink fountain, a beverage storage location, and a coffee filling area.

7. The bakery-cafe as recited in 1 wherein one or more of the plurality of stations arranged sequentially separate the food preparation and staging area from the general customer area.

8. The bakery-cafe as recited in 1 wherein the first end of the food preparation and staging area is in the vicinity of an entrance of the bakery-cafe.

* * * * *

UNITED STATES PATENT AND TRADEMARK OFFICE

CERTIFICATE OF CORRECTION

PATENT NO. : 8,006,804 B2
APPLICATION NO. : 11/222580
DATED : August 30, 2011
INVENTOR(S) : Anthony M. Coleman et al.

It is certified that error appears in the above-identified patent and that said Letters Patent is hereby corrected as shown below:

Col. 7, line 11, in Claim 1, delete "area" and insert -- area, --, therefor.

Col. 8, line 3, in Claim 4, delete "1" and insert -- claim 1, --, therefor.

Col. 8, line 5, in Claim 5, delete "1" and insert -- claim 1, --, therefor.

Col. 8, line 8, in Claim 6, delete "1" and insert -- claim 1, --, therefor.

Col. 8, line 13, in Claim 7, delete "1" and insert -- claim 1, --, therefor.

Col. 8, line 17, in Claim 8, delete "1" and insert -- claim 1, --, therefor.

Signed and Sealed this
Eighteenth Day of October, 2011

David J. Kappos

David J. Kappos
*Director of the United States Patent and Trademark Office*